US008371884B2

(12) United States Patent
Mazingue-Desailly et al.

(10) Patent No.: US 8,371,884 B2
(45) Date of Patent: Feb. 12, 2013

(54) DEVICE AND METHOD FOR CONNECTING AT LEAST TWO ELECTRIC TERMINALS

(75) Inventors: Stephan Mazingue-Desailly, Ludwigsburg (DE); Roland Hellwig, Asperg (DE); Michael Mueller, Rutesheim (DE)

(73) Assignee: Robert Bosch GmbH, Stuttgart (DE)

( * ) Notice: Subject to any disclaimer, the term of this patent is extended or adjusted under 35 U.S.C. 154(b) by 410 days.

(21) Appl. No.: 12/642,154

(22) Filed: Dec. 18, 2009

(65) Prior Publication Data

US 2010/0210153 A1 Aug. 19, 2010

(30) Foreign Application Priority Data

Feb. 13, 2009 (DE) ..... 10 2009 000 827

(51) Int. Cl.
*H01R 4/10* (2006.01)

(52) U.S. Cl. ..... 439/879; 439/877; 174/84 C

(58) Field of Classification Search ..... 439/877–879; 174/84 C

See application file for complete search history.

(56) References Cited

U.S. PATENT DOCUMENTS

2011/0003519 A1* 1/2011 Oka et al. ..... 439/879

FOREIGN PATENT DOCUMENTS

| | | |
|---|---|---|
| DE | 3516764 | 1/1986 |
| DE | 44 31 274 | 3/1996 |
| DE | 299 12 797 | 1/2000 |
| DE | 199 61 311 | 7/2001 |
| DE | 10 2004 046 855 | 9/2004 |
| DE | 20 2005 013 220 | 1/2006 |
| DE | 10 2005 030 393 | 2/2006 |
| DE | 10 2004 055 847 | 6/2006 |
| DE | 102004058452 | 6/2006 |
| DE | 102005039462 | 3/2007 |
| DE | 10 2007 026 707 | 9/2008 |
| EP | 2 068 402 | 6/2009 |

* cited by examiner

*Primary Examiner* — Khiem Nguyen
(74) *Attorney, Agent, or Firm* — Kenyon & Kenyon LLP

(57) ABSTRACT

A device and a method for connecting at least two electric terminals, particularly an electrode terminal and an electric measuring element, the two terminals being connected to each other by clinching.

9 Claims, 4 Drawing Sheets

DEVICE AND METHOD FOR CONNECTING AT LEAST TWO ELECTRIC TERMINALS

BACKGROUND INFORMATION

A terminal post device is described in German Patent No. DE 10 2004 046 855. A fastening element is provided for fastening a measuring resistor to an electrode terminal, the fastening element including a stud that passes through the fastening range of the battery sensor, having an insulating sleeve that surrounds it. Thus, at least three parts are required for setting up a connection.

Starting from this, it is an object of the present invention to achieve a great strength in spite of the reduction in the number of parts of the connection design.

SUMMARY OF THE INVENTION

The device and the method, according to the present invention, for connecting two electric terminals have the advantage that an electrical and also a mechanical connection is able to be produced without using an interference-fit stud. Consequently, it is possible, when using it with an electrode terminal, to fasten an electrical measuring element to an electrode terminal in a conductive manner without additional parts. Clinching is particularly suitable for this purpose.

In one expedient refinement it is provided that, for the purpose of performing clinching, a recess is provided in one of the electric terminals, in which the second terminal is situated in an at least partially press-fit manner. The recess is preferably a hole which on its rear side is slightly countersunk or beveled. This makes it possible, when the terminal is press-fit into this recess, that the material thus press-fit also forms a back taper, so that a rivet head is created. This has an especially positive effect on the mechanical and electrical properties of the connection.

In one expedient refinement, as the materials for the terminals, on the one hand, a machining alloy CuZn39Pb2 is used, as well as SE-Cu58 for the shunting arrangement. The softer material SE-Cu58 for the shunting arrangement is clinched in the direction of the hard material CuZn39Pb2 for the electrode terminal. The electrode terminal is a forging, in this instance, which, after the reforming that leads to the fastening of the material, at the simultaneous reduction of the elongation at failure, could be submitted to heat treatment for the improvement in its workability. Crack-free connections are preferably produced using the following material combinations: CuZn37 with SE-Cu58, CuZn37 with SE-Cu58 at different thicknesses. A connection between the materials CuZn39Pb2 and SE-Cu58 could certainly be produced using a countersunk hole on the back side in the material CuZn39Pb2.

In one expedient refinement, the one electric terminal is an electrode terminal and the other electric terminal is a measuring resistor. The electrode terminal is preferably developed so that it is able to be situated at one battery terminal of a vehicle battery, in order to deduce certain battery state variables such as the charging state or the ageing state of the battery by using the measuring resistor and integrated electronics. The battery terminal is made of the material CuZn39Pb2, in this case, and the terminal element of the resistor is made of SE-Cu58. For this combination, clinching is particularly effective, using a recess situated in the electrode terminal.

DETAILED DESCRIPTION

Figure 1:
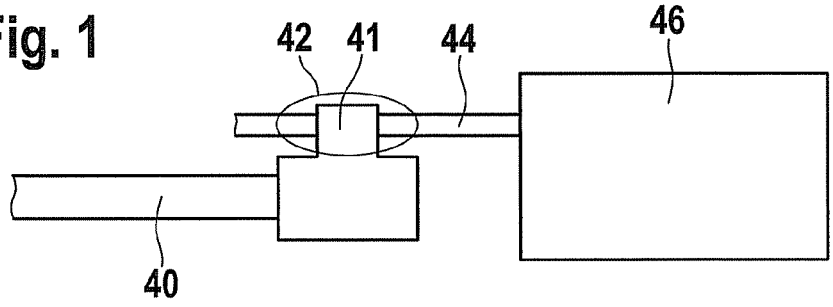
FIG. 1 shows the design, in principle, for connecting a control device to a cable, using clinching.

According to the exemplary embodiment as in FIG. 1, a current bar 44 projects from a control device 46, which is connected by a connection 42 to a ground cable 40. For this purpose, ground cable 40 is provided with a terminal 41.

Figure 2:
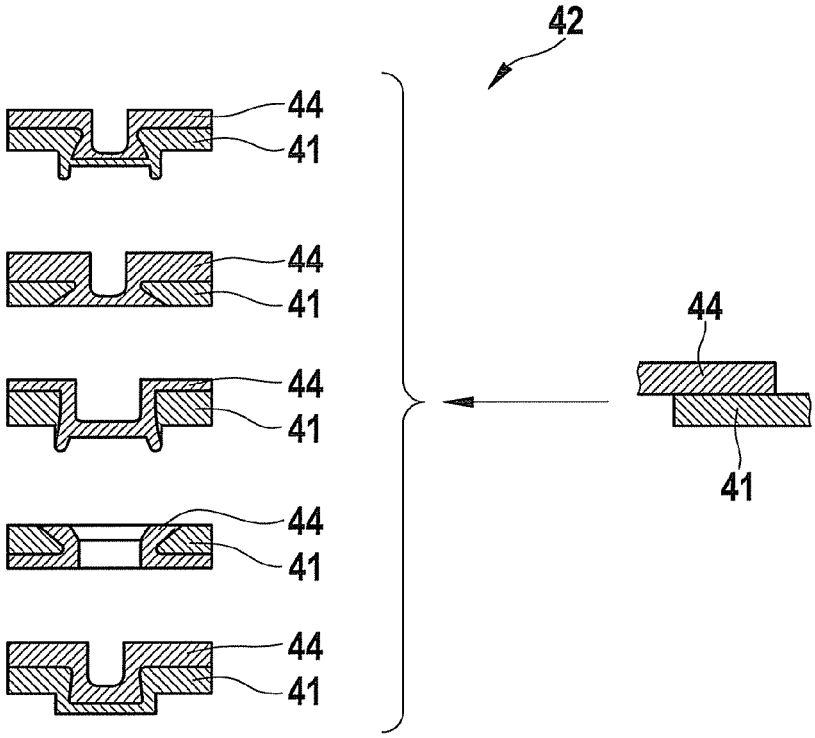
FIG. 2 shows different types of clinching.

On the left side of FIG. 2, different variants of connection 42 are shown, with which current bar 44 (as a possible example for a terminal) and terminal 41, as in FIG. 1, may be connected. It is in common to all connections 42 that they are produced by clinching.

Figure 3:
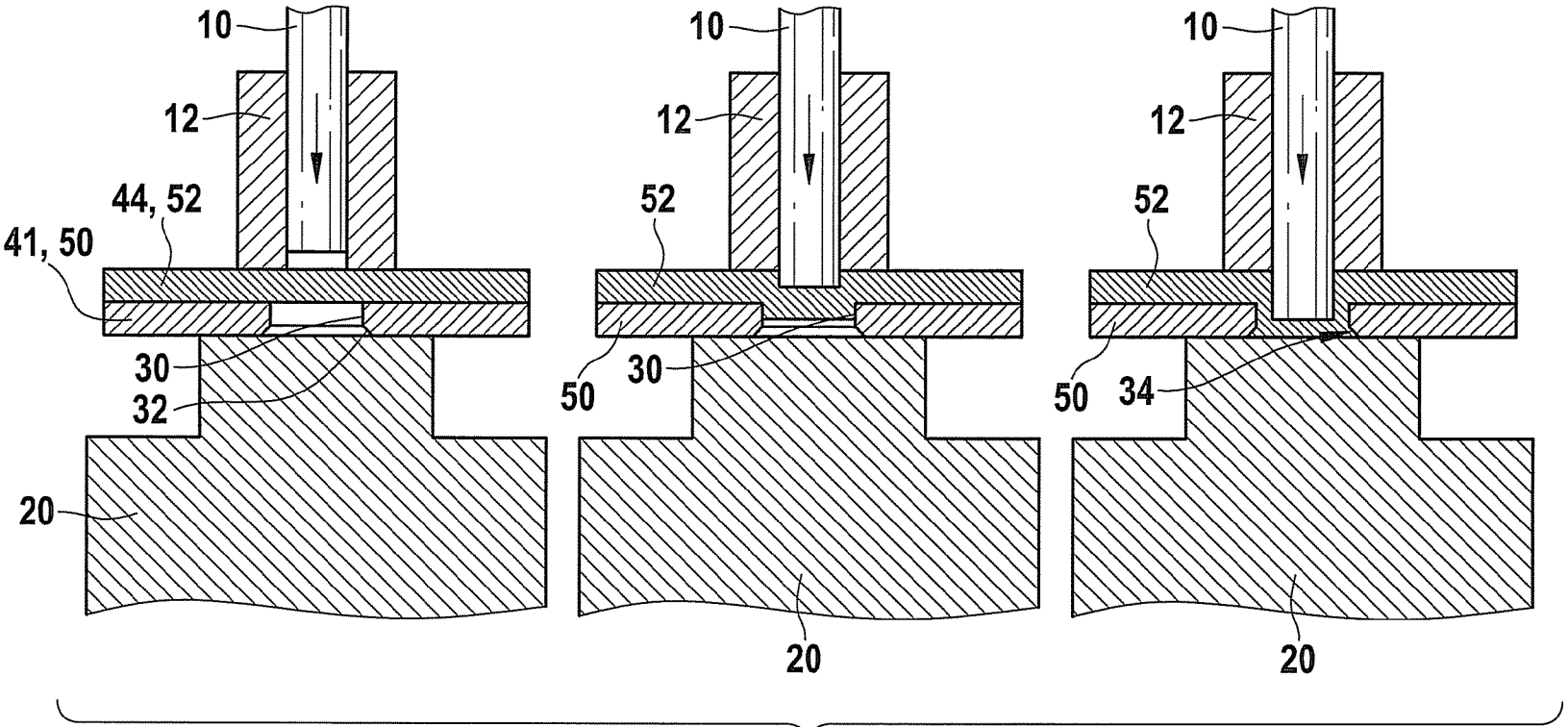
FIG. 3 shows sectional views of three production steps.

FIG. 3 shows a possible type of production of connection 42 in exemplary fashion. Terminal 41 has an opening 30, having a bevel 32 on its lower side. Terminal 41 is situated on an anvil 20. Above terminal 41 there is a current bar 44. Above opening 30, a punch is positioned concentrically which is guided movably with respect to a holding-down clamp 12. Initially, punch 10 is still located above current bar 44. In the following step, shown in the second illustration according to FIG. 3, punch 10 is moved downwards, and it displaces the material of terminal 41 present at this location into opening 30. In the third illustration, punch 10 proceeds to its end position. The material of terminal 41 displaced by punch 10 completely fills opening 30, inclusive of bevel 32, so that a back taper 34 develops when bevel 32 is also fully provided with the material of terminal 41.

Figure 4:
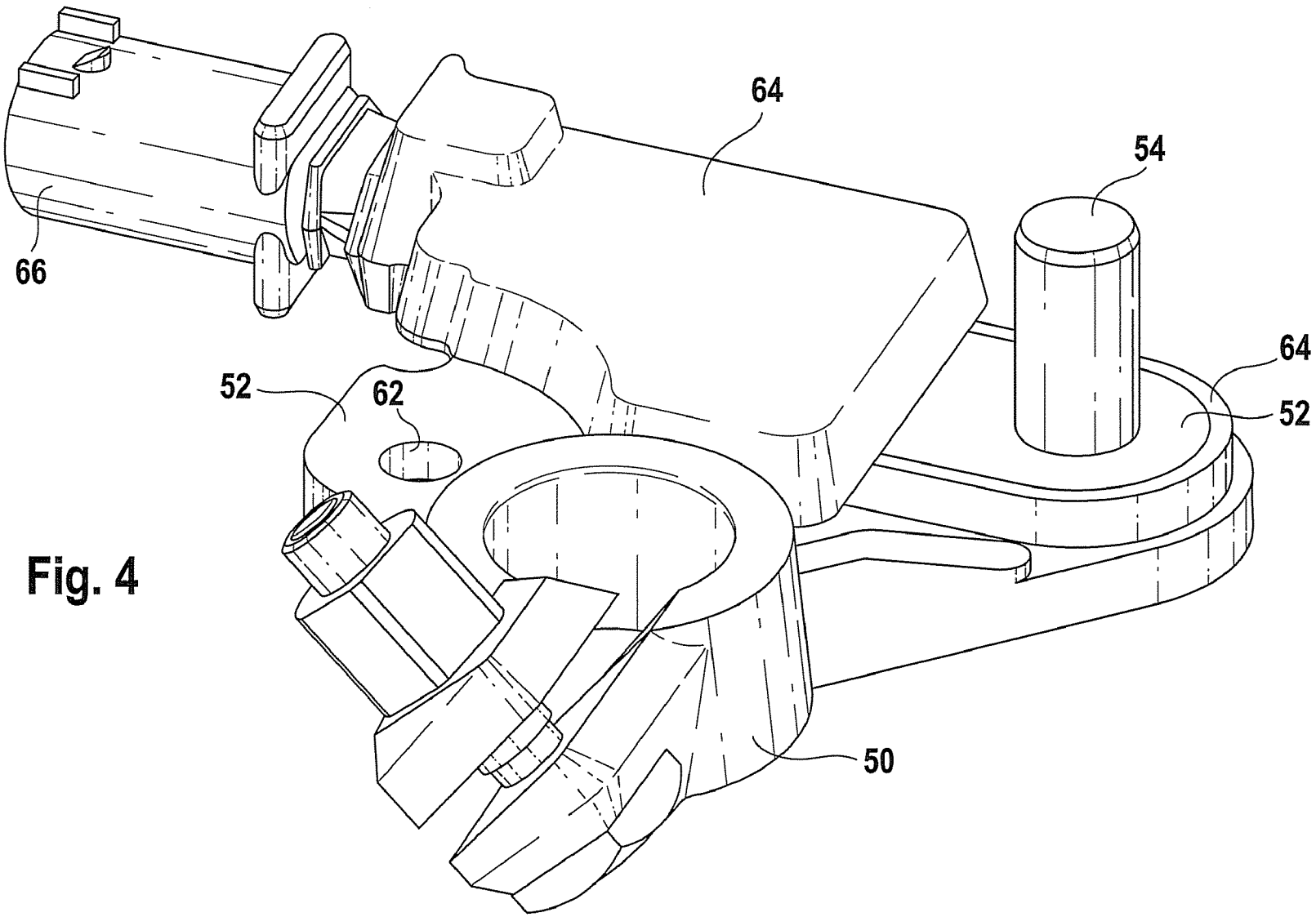
FIG. 4 shows a perspective view of an electrode terminal having an electric measuring element.
Figure 5:
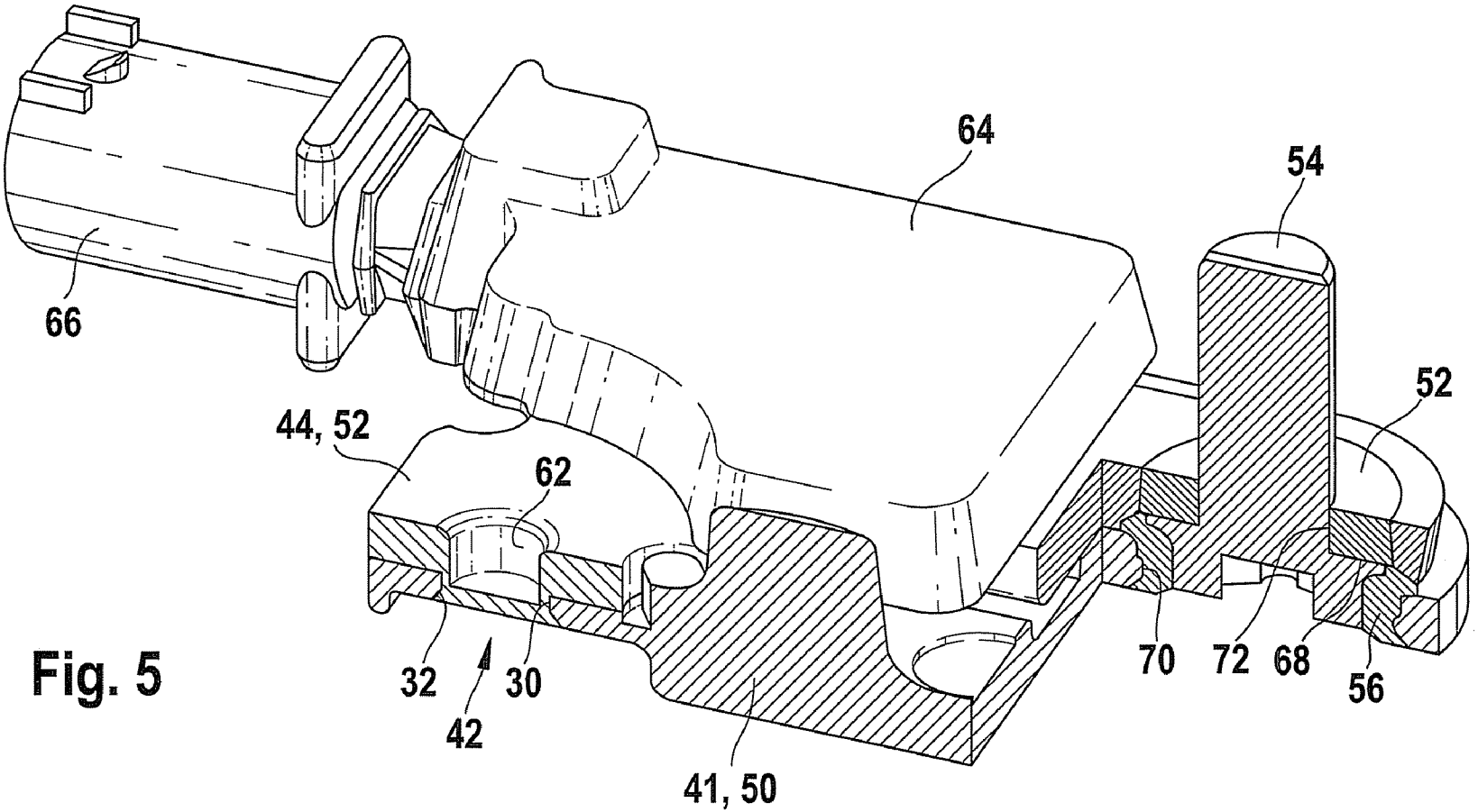
FIG. 5 shows the arrangement according to FIG. 4, shown in partial section.

In the exemplary embodiment according to FIG. 4, an electrode terminal 50 is shown, which is able to be connected to a battery terminal (not shown) of a battery, for instance, a motor vehicle battery. For this purpose, the legs (not designated in greater detail) of the electrode terminal may be moved in such a way towards each other that they enclose the battery terminal in clamping fashion. The arrangement also includes a measuring element 52. Measuring element 52 is connected on one side, by a press-fit connection 42, directly to electrode terminal 50 using clinching. In accordance with the production according to FIG. 3, electrode terminal 50 has an opening 30 having a bevel 32 on its back side. Into this opening 30, the connection, current bar 44 or measuring element 52 has been press-fit in such a way, using clinching, that a back taper 34 of terminal 41 forms in the vicinity of bevel 32. In FIGS. 4 and 5 one may also see recesses 62 of current bar 44 or measuring element 52, which have been developed by punch 10, based on the plastic deformation of current bar 44 or measuring element 52. Besides the mechanical contacting between electrode terminal 50 and measuring element 52, a secure electrical contacting is also achieved in this manner, so as to conduct the battery current via measuring element 52 and to record it.

Electrode terminal 50 has an additional recess 70 which is used to fasten a stud 54. This stud 54 is made to be cylindrical, for example, and projects upwards, perpendicularly with respect to the planar plane of measuring element 52. A sleeve 56 is situated radially surrounding stud 54, between stud 54 and electrode terminal 50. This is made up of an electrically nonconductive material, for the insulation of the second connecting point of measuring element 52 from electrode terminal 50. This ensures that the battery current between stud 54, for the connection of ground cable 40 and the terminal, connected to the battery terminal, actually flows via measuring element 52, and is not short circuited. A corresponding additional recess 72 of measuring element 52 is brought into line with the outside diameter of stud 54. Measuring element 52 lies partially on a collar 68 on stud 54 that radially increases in size, but partially also on the upper side of sleeve 56. The upwards projecting side of stud 54 may be provided with a thread, not shown, for fastening a cable lug of a cable, preferably ground cable 40, using a screw connection. In the vicinity of stud 54, measuring element 52 is surrounded by a housing 64 only on the side, while the surface of measuring element 52 is exposed. Since measuring element 52 is at this place only connected to electrode terminal 50 via sleeve 56, there is no electrical contact at this location. Measuring element 52 is guided in the direction of housing 64 into the housing's inside. That is where the actual measuring element is located, for instance, a resistor made of a certain material, such as Manganin. There is also an electronics system (not shown) within housing 64, which records the voltage drop at the measuring resistor and evaluates it in further signal processing.

Furthermore, with the aid of additional data, such as the battery voltage, the temperature or similar battery state variables, such as the state of charge (SOC) or the state of health (SOH) of the battery may be ascertained. These data may be passed on via an unshown data line, which is connected via plug 66, to additional control devices such as an energy management control device. Measuring element 52 is guided out of housing 64 on the side facing away from stud 64. That is where the electrical contacting also takes place, using connection 42 obtained by clinching, as has been described. It is important, however, that the electrical contacting between measuring element 52 and electrode terminal 50 takes place, with reference to the actual measuring resistor, only on the side facing away from stud 54. For, then the current is conducted from the battery terminal via electrode terminal 50, via connection 42 to the left connecting point of measuring element 52, via the measuring resistor, lying inside housing 64, all the way to stud 54, to which ground cable 40 is then to be connected.

As shown in FIG. 2, connection 42 is formed using clinching. This is understood to mean a method for connecting sheet metals without using an additional material. The joining is achieved by reforming at least one material, in this instance. It may be seen according to FIG. 2 that terminal 41 and current bar 44 as an example for an additional terminal, as shown on the left, have experienced plastic deformation after the clinching, so that a mechanically firm and also an electrically conductive connection 42 is produced. In the case of the variants shown in FIG. 2, both current bar 44 and terminal 41 are deformed. This is not essential, however. The deformation of only one sheet metal is sufficient, either current bar 44 or terminal 41.

In the exemplary embodiment shown in FIGS. 4 and 5, for connecting a measuring element 52 to electrode terminal 50, clinching has proven itself, as shown in FIG. 3. In this instance, electrode terminal 50 corresponds to terminal 41, current bar 44 corresponds to the terminal of measuring element 52. Electrode terminal 50 is preferably a forging which, after the reforming, results in a firming up of the material while simultaneously reducing in the elongation at failure. The materials to be deformed could be subjected to heat treatment, to improve their workability. A machining alloy, particularly preferably CuZn39Pb2, is especially suitable for this. The terminal of measuring element 52 is preferably made of SE-Cu58. A mechanical and electrical connection between measuring element 52 and electrode terminal 50 is achieved by the clinching. To do this, using the production method as in FIG. 3 of the two sheet metals 44, 52; 41, 50, as it were, a riveted connection 42 is produced by clinching, without having to use an additional component part. Because of punch 10, measuring element 52, which is made of a softer material than electrode terminal 50, is press-fitted into opening 30. Clinching is finished when the displaced material of measuring element 52 also reaches bevel 32 of opening 30, so that a back taper 34 is formed. The diameter of opening 30 is preferably in a range of ca. 5 mm or greater (for example, 6.4 mm) or greater (such as 7.4 mm, if sufficient space is available). Electrode terminal 50 is made, in this instance, of CuZn39Pb2, and has an opening 30 that is beveled on the back side. The ductile copper (SE-Cu58) is drawn through the beveled hole in such a way that back taper 34 is created, and a rivet head is formed.

Using a suitable choice of material, one may also do without providing an opening 30, so that the geometries shown in FIG. 3 are achieved. Punch 10 and anvil 20 have to be adapted in a corresponding manner.

Clinching, so as to set up a connection 42, is particularly suitable for contacting terminal 41 and current bar 44 (as examples for an additional terminal) of a control device. Based on the material selection undertaken, however, clinching is especially suitable for setting up connection 42 between electrode terminal 50 and measuring element 52.

What is claimed is:

1. A device for connecting at least two electric terminals, comprising:

an arrangement for connecting the two terminals to each other by clinching, wherein a first of the terminals has at least one opening, into which a second of the terminals is at least partially deformed using clinching, wherein the opening has a bevel provided at a rear end of the opening.

2. The device according to claim 1, wherein the two terminals are an electrode terminal and a measuring element.

3. The device according to claim 1, wherein the terminals are made of materials having different strengths.

4. The device according to claim 1, wherein the second terminal forms a back taper in a vicinity of the bevel, because of the clinching.

5. The device according to claim 1, wherein at least one of (a) the first terminal is made of a machining alloy and (b) the second terminal is made of a ductile material, including copper.

6. The device according to claim 1, wherein at least one of (a) the first terminal is an electrode terminal and (b) the second terminal is a measuring element.

7. The device according to claim 6, wherein the electrode terminal and the measuring element are connected at at least one location using clinching and at another location using a stud, insulated from each other by a sleeve.

8. The device according to claim 1, wherein at least one of (a) the first terminal is made of CuZn39Pb2 and (b) the second terminal is made of SE-Cu58.

9. The device according to claim 1, wherein the bevel is provided only at the rear end of the opening.

* * * * *